United States Patent [19]

Kuwahara

[11] Patent Number: 4,471,622

[45] Date of Patent: Sep. 18, 1984

[54] RANKINE CYCLE APPARATUS

[75] Inventor: Eiji Kuwahara, Fuji, Japan

[73] Assignee: Tokyo Shibaura Denki Kabushiki Kaisha, Kawasaki, Japan

[21] Appl. No.: 397,780

[22] Filed: Jul. 13, 1982

[30] Foreign Application Priority Data

Jul. 22, 1981 [JP] Japan ..... 56-108820[U]

[51] Int. Cl.[3] ..... F22D 5/00

[52] U.S. Cl. ..... 60/667; 60/686

[58] Field of Search ..... 60/665, 667, 686

[56] References Cited

U.S. PATENT DOCUMENTS

| | | | |
|---|---|---|---|
| 3,774,396 | 11/1973 | Borsi et al. | 60/667 |
| 3,894,396 | 7/1975 | Durrant | 60/665 |
| 3,906,731 | 9/1975 | Carlson | 60/667 |
| 4,020,637 | 5/1977 | Izumi | 60/667 |
| 4,117,344 | 9/1978 | Boerstler et al. | 60/667 |
| 4,297,848 | 11/1981 | Silvestri, Jr. | 60/667 |

FOREIGN PATENT DOCUMENTS

| | | | |
|---|---|---|---|
| 645394 | 6/1928 | France | 60/667 |
| 71203 | 6/1979 | Japan | 60/665 |
| 55-63337 | 5/1980 | Japan . | |

*Primary Examiner*—Stephen F. Husar

*Attorney, Agent, or Firm*—Oblon, Fisher, Spivak, McClelland & Maier

[57] ABSTRACT

A Rankine cycle apparatus comprises a circulating pump for circulating a working medium through the apparatus, a gas generator having a tube connected with the outlet side of the circulating pump wherein the working medium flowing in the tube is evaporated, an expander connected with the outlet side of the tube of the gas generator, a condenser having a tube connected between the outlet side of the expander and the inlet side of the circulating pump wherein the working medium flowing the tube is condensed, pressure and temperature sensors for sensing the pressure and temperature of the working medium at the outlet side of the gas generator, and a flow control valve for controlling the rate of flow of the working medium to the gas generator on the basis of the pressure and temperature sensed by the sensors.

4 Claims, 5 Drawing Figures

RANKINE CYCLE APPARATUS

BACKGROUND OF THE INVENTION

This invention relates to a heat-drive refrigerating or Rankine cycle apparatus for controlling the flow rate of a working medium.

In a conventional Rankine cycle apparatus, a heat drive cycle system is formed by connecting an expander successively with a condenser, a pump, and a gas generator. A working medium, e.g., a refrigerant in a liquid phase, is delivered from the condenser to the gas generator, where it is converted into a high-pressure gas, and then transferred to the expander. Thus, the expander is actuated by the gas pressure to drive a refrigerating cycle system.

In the operation of the apparatus, the flow rate of the working medium supplied to the gas generator by the pump does not always agree with the flow rate of the working medium consumed at the expander due to variations in the working medium temperature, load conditions, etc., at the gas generator.

Conventionally, therefore, if the quantity of flow supplied from the pump is larger than the quantity of flow passing through the expander, then a liquid refrigerant will be discharged from the gas generator to lower the drive efficiency, or a gas refrigerant will be sucked into the pump. In the contrary case, the liquid refrigerant will stay in the condenser. In either case, the drive cycle would not be able to operate satisfactorily.

Most Rankine cycle apparatus hitherto known are large and massive. They are provided with a gas generator and a condenser of the type which comprises a housing containing a coolant and a spiral water tube disposed in the housing. Heat is exchanged between the water in the tube and the coolant in the housing. The flow of the Rankine cycle is controlled by adjusting the output of a pump for circulating the coolant so that the surface of the coolant in the housing is maintained at a specific level.

With a small Rankine cycle apparatus to which the present invention is applied, however, it is impossible to hold the coolant surface in the housing at a specific level. This is because the coolant flows through the tube of either the gas generator or the condenser since the tube is a finned tube or a double tube.

SUMMARY OF THE INVENTION

The object of this invention is to provide a Rankine cycle apparatus capable of harmonizing the rate of flow of a working medium supplied to a gas generator with the flow rate of a working medium discharged from an expander.

DETAILED DESCRIPTION OF THE PREFERRED EMBODIMENT

There will now be described a Rankine cycle apparatus according to an embodiment of this invention with reference to the accompanying drawings.

Figure 1:
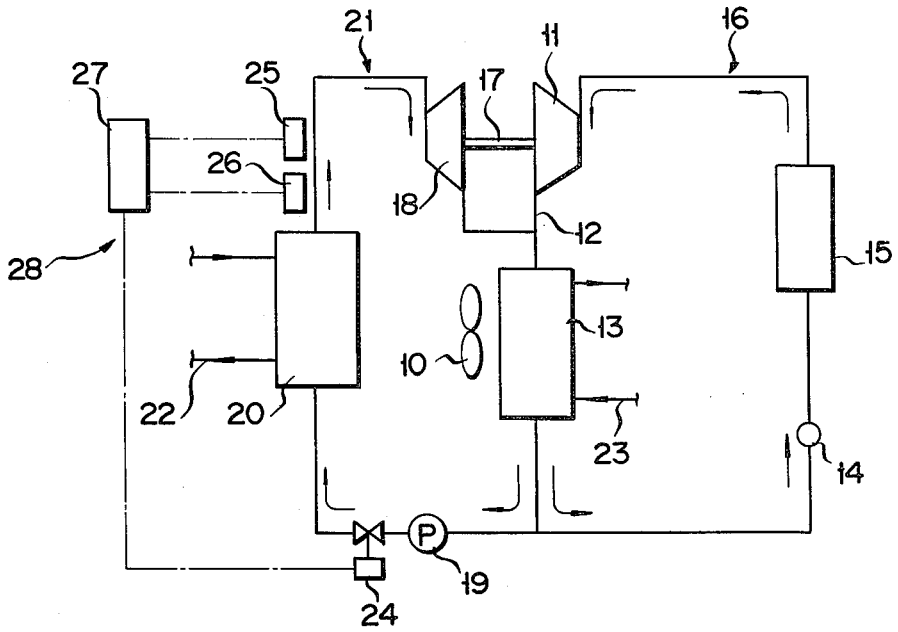
FIG. 1 shows a Rankine cycle apparatus according to an embodiment of this invention.

In FIG. 1, numeral 11 designates a compressor. A condenser 13 is connected to the outlet side of the compressor 11 through a refrigerant pipe 12. A cooler 15 is connected to the outlet side of the condenser 13 through an expansion valve 14. The inlet side of the compressor 11 is connected to the outlet side of the cooler 15. Thus, these members 11 to 15 constitute a conventional refrigerating cycle system 16. Disposed near the condenser 13 is a fan 10 for cooling the same.

The compressor 11 is connected with an expander 18 through a rotating shaft 17 of the compressor 11. The inlet side of a circulating pump 19 is connected to the outlet side of the expander 18 through a condensing tube of the condenser 13. The outlet side of the pump 19 is connected with the inlet side of an evaporating tube of a gas generator 20 through a control valve 24. The outlet side of the gas generator 20 is connected to the inlet side of the expander 18. Thus, these members constitute a heat drive cycle system 21. Warm water is fed into a housing of the gas generator 20 through a circuit 22 to evaporate the working medium flowing the tube in the housing, while cool water is fed into a housing of the condenser 13 through a circuit 23 to condense the working medium flowing the tube in the housing. The warm water is produced by, for example, a solar heater. Provided at the outlet side of the gas generator 20, that is, at the inlet side of the expander 18, are a temperature sensor 25 and a pressure sensor 26 for sensing the temperature and pressure, respectively, of a working medium or refrigerant flowing through the gas generator 20 and the expander 18. The temperature and pressure sensors 25 and 26 are connected to the input side of a controller 27. The output side of the controller 27 is connected to the control valve 24. The controller 27 receives signals from the temperature and pressure sensors 25 and 26, adjusts the opening of the control valve 24 in accordance with the temperature and pressure of the refrigerant at the inlet side of the expander 18, and controls the rate of flow of the refrigerant supplied to the gas generator 20. The control valve 24, the temperature and pressure sensors 25 and 26, and the controller 27 constitute a flow control mechanism 28. The flow control mechanism 28 and the heat drive cycle system 21 constitute the Rankine cycle apparatus.

There will now be described the operation of the Rankine cycle apparatus of the above-mentioned construction.

When the circulating pump 19 of the heat drive cycle system 21 is actuated, a liquid refrigerant discharged from the condenser 13 is delivered through the control valve 20 to the gas generator 20, where it is heated by the warm water and then carried to the expander 18. The condenser 13 and gas generator 20 may be of such a type that the refrigerant flows through a finned tube or double tube and the warm water flows outside the pipe. The gas refrigerant is expanded in the expander 18 to produce a pressure, which causes the rotating shaft 17 to rotate, thereby actuating the compressor 11 of the refrigerating cycle system 16. As a result, a compressed refrigerant gas is discharged from the compresor 11, delivered to the condenser 13 to be liquefied therein, and then transferred to the cooler 15 via the expansion valve 14. At the cooler 15, the liquefied gas is evaporated to cool a room, for example, and sucked into the condenser 11.

In the normal operation, the flow rate of the refrigerant supplied from the circulating pump 19 balances with the flow rate of the refrigerant consumed at the expander 18, and the gas refrigerant at the outlet side of the gas generator 20 is superheated to a temperature of approximately 5° C. (this temperature is reached where the gas generator 20 has a double tube structure).

If the load on the expander 18, for example, increases to reduce the rotational frequency in the aforesaid operation, the refrigerant supply from the circulating pump 19 is increased. As a result, all the liquid refrigerant cannot evaporate at the gas generator 20, so that the temperature of superheat of the gas refrigerant at the outlet side of the gas generator 20 is lowered. If the rotational frequency of the expander 18 increases, on the other hand, the discharge of the gas refrigerant from the expander 18 is increased to raise the temperature of the superheat of the gas refrigerant at the outlet side of the gas generator 20.

The aforesaid superheat is detected when the temperature and pressure of the gas refrigerant discharged from the gas generator 20 are sensed by the temperature and pressure sensors 25 and 26 in operation. If the detected value is lower than a set point, the control valve 24 is throttled by the controller 27, so that the discharge of the gas refrigerant from the circulating pump 19 is reduced.

If the detected value is higher than the set point, on the other hand, the control valve 24 is opened wide, so that the discharge of the liquid refrigerant from the circulating pump 19 is increased.

In the apparatus of the above-mentioned construction, the discharge of the gas refrigerant from the circulating pump 19 is controlled in accordance with the superheat of the gas refrigerant discharged from the gas generator 20, so that the superheat may be maintained at a set level.

Figure 2:
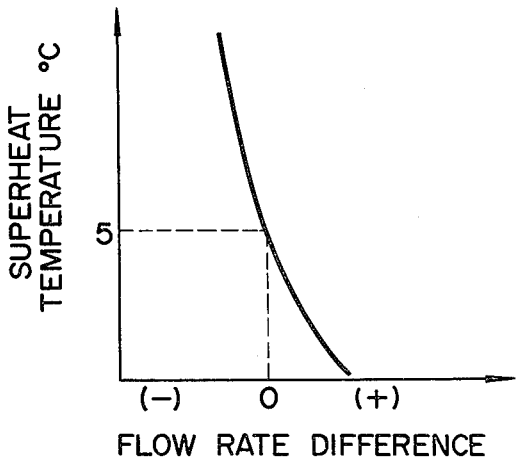
FIG. 2 shows the relationship between the superheat temperature and the difference between the pump discharge and expander flow rate.

FIG. 2 shows the relationship between the temperature of the superheat of the gas refrigerant and the difference between the rates of flow at the outlet side of the pump and at the expander. In FIG. 2, the axis of ordinate represents the superheat temperature, and the axis of abscissa represents the difference.

Figure 3:
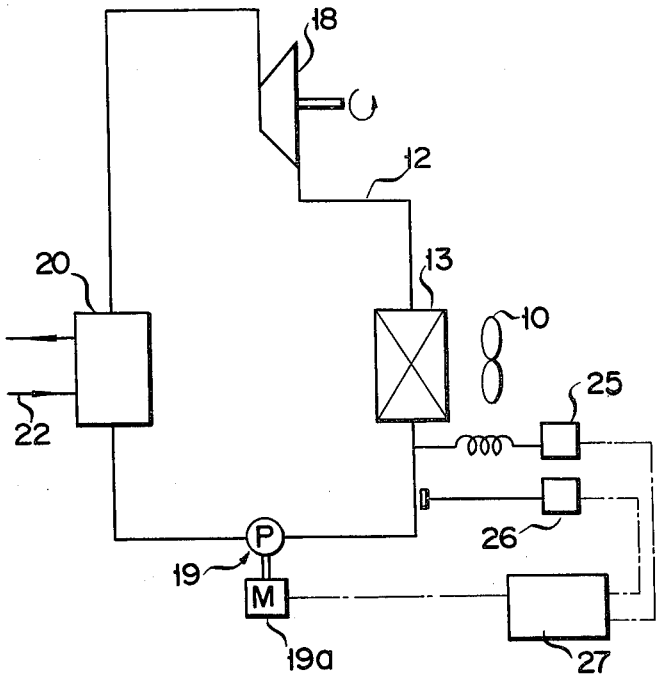
FIGS. 3 to 5 show several modifications of the Rankine cycle apparatus.
Figure 4:
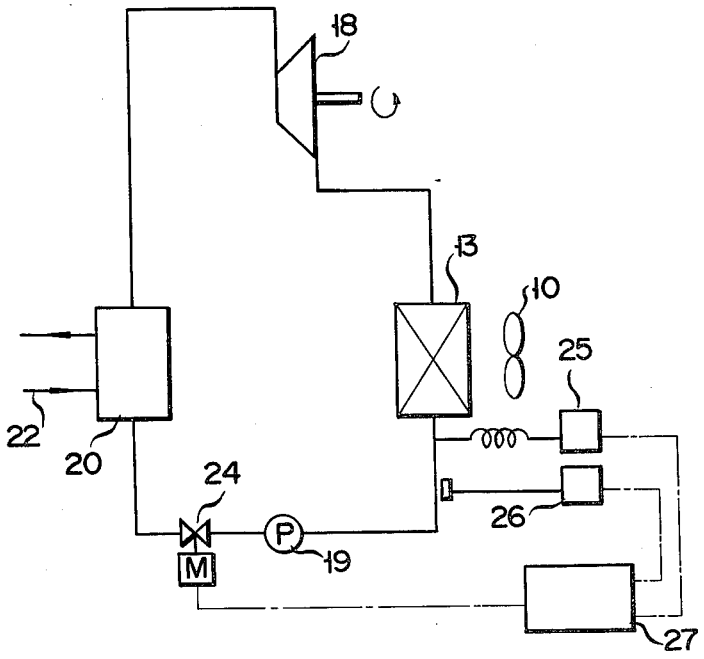
Figure 5:
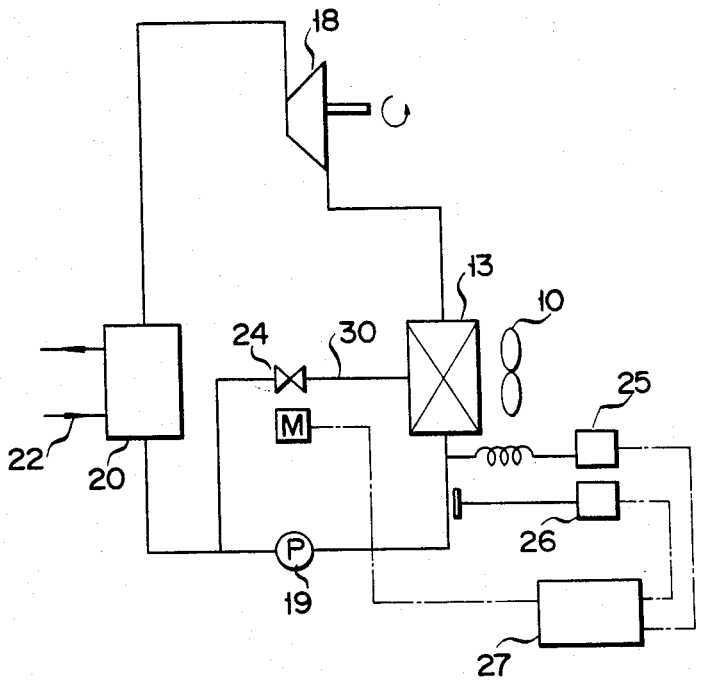

In the above-mentioned embodiment, the rate of flow of the refrigerant at the outlet side of the pump 19, i.e., at the inlet side of the gas generator 20, is controlled by the valve 24 provided between the pump 19 and the gas generator 20. The flow rate may, however, be controlled by any other suitable means. Further, the sensors to sense the temperature and pressure of the refrigerant at the inlet side of the expander 18 need not always be disposed at the outlet side of the gas generator 20. Referring now to FIGS. 3 to 5, there will be described several modifications of the apparatus which embody the spirit of the aforesaid alternatives. In the description of the modifications to follow, like reference numerals are used to designate substantially the same portions as those of the foregoing embodiment.

In the apparatus shown in FIG. 3, the pressure and temperature sensors 25 and 26 are provided at the outlet side of the condenser 13 to detect the pressure and temperature, respectively, of the refrigerant passing therethrough. The pump 19 has a control section 19*a* capable of controlling its rotational frequency. The discharge of the pump 19 is controlled by the controller 27 with the aid of the control section 19*a*. Thus, the flow rate of the refrigerant to the gas generator 20 is controlled on the basis of the pressure and temperature of the refrigerant at the outlet side of the condenser 13.

In the modification shown in FIG. 4, the flow rate of the refrigerant to the gas generator 20 is controlled by the valve 24 in the same manner as in the embodiment shown in FIG. 1. The pressure and temperature sensors 25 and 26 are disposed at the outlet side of the condenser 13.

In the modification shown in FIG. 5, a by-pass 30 off the pump 19 is disposed between the condenser 13 and the inlet side of the gas generator 20, and the flow control valve 24 whose opening is controlled by the controller 27 is attached to the by-pass 30. Thus, the flow rate of the refrigerant to the gas generator 20 is controlled.

In the above-mentioned Rankine cycle apparatus, the pressure and temperature of a working medium between the inlet side of an expander and the outlet side of a condenser are detected, and the flow rate of the working fluid to a gas generator is controlled on the basis of the detected pressure and temperature. Accordingly, the flow rate of the working medium supplied to the gas generator can continually be kept coincident with the flow rate of the working medium consumed at the expander. Thus, the operating efficiency of the apparatus can be maintained high.

What is claimed as new and desired to be secured by Letters Patent of the United States is:

1. A Rankine cycle apparatus comprising:

a circulating pump for circulating a working medium through the apparatus;

a gas generator having a tube connected with the outlet side of the circulating pump wherein the working medium flowing in the tube is evaporated;

an expander connected with the outlet side of the tube of the gas generator;

a condenser having a tube connected between the outlet side of the expander and the inlet side of the circulating pump wherein the working medium flowing in the tube is condensed;

sensing means for sensing the pressure and temperature of the working medium between the inlet side of the expander and the outlet side of the condenser, wherein said sensing means includes a pressure sensor and a temperature sensor for sensing the pressure and temperature, respectively, of the working medium at the outlet side of the condenser; and control means for controlling the rate of flow of the working medium to the gas generator on the basis of the pressure and temperature sensed by the sensing means.

2. The Rankine cycle apparatus according to claim 1 wherein said control means includes means for controlling the discharge of the circulating pump.

3. The Rankine cycle apparatus according to claim 1 wherein said control means includes a flow control valve provided between the circulating pump and the gas generator.

4. The Rankine cycle apparatus according to claim 1 wherein said control means includes a by-pass of the circulating pump connected between the condenser and the inlet side of the gas generator, and a flow control valve attached to the by-pass.

* * * * *